US010669714B2

(12) United States Patent
Hussin et al.

(10) Patent No.: US 10,669,714 B2
(45) Date of Patent: Jun. 2, 2020

(54) PREFABRICATED MODULE FOR A PITCHED ROOF ELEMENT AND PITCHED ROOF ELEMENT FOR A BUILDING ROOF

(71) Applicant: Rockwool International A/S, Hedehusene (DK)

(72) Inventors: Ala Hussin, Bergschenhoek (NL); Stephen Muller, Heerhugowaard (NL)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 16/087,400

(22) PCT Filed: Mar. 15, 2017

(86) PCT No.: PCT/EP2017/056122
§ 371 (c)(1),
(2) Date: Sep. 21, 2018

(87) PCT Pub. No.: WO2017/162498
PCT Pub. Date: Sep. 28, 2017

(65) Prior Publication Data

US 2019/0106882 A1 Apr. 11, 2019

(30) Foreign Application Priority Data

Mar. 23, 2016 (EP) ..... 16161965

(51) Int. Cl.
*E04C 1/00* (2006.01)
*E04B 7/22* (2006.01)
(Continued)

(52) U.S. Cl.
CPC ..... *E04B 7/225* (2013.01); *E04B 1/26* (2013.01); *E04B 7/22* (2013.01); *E04B 7/24* (2013.01); *E04D 13/1631* (2013.01)

(58) Field of Classification Search
CPC ... E04B 7/225; E04B 1/26; E04B 7/22; E04B 7/24; E04D 13/1631
(Continued)

(56) References Cited

U.S. PATENT DOCUMENTS 2,239,394 A * 4/1941 MacKechnie ..... E04B 1/7666 52/407.3
2,330,941 A * 10/1943 Acuff, Jr. ..... E04B 1/7612 52/407.1
(Continued)

FOREIGN PATENT DOCUMENTS

BE 1012910 A6 5/2001
DE 19543330 A1 5/1997
(Continued)

*Primary Examiner* — Basil S Katcheves
(74) *Attorney, Agent, or Firm* — Harness, Dickey & Pierce, P.L.C.

(57) ABSTRACT

The present disclosure relates to a prefabricated module for a pitched roof element comprising a frame made of at least two first beams being arranged in a distance and running parallel to each other and two second beams running rectangular to the first beams and being connected to the ends of the first beams forming a compartment into which a first layer of an insulation is inserted and a pitched roof element for a building roof made of at least two modules, each comprising a frame made of at least first beams being arranged in a distance and running parallel to each other and two second beams running rectangular to the first beams and being connected to the ends of the first beams forming a compartment into which a first layer of an insulation is inserted.

12 Claims, 4 Drawing Sheets

(51) Int. Cl.
*E04B 7/24* (2006.01)
*E04B 1/26* (2006.01)
*E04D 13/16* (2006.01)

(58) Field of Classification Search
USPC ..... 52/309.11
See application file for complete search history.

(56) References Cited

U.S. PATENT DOCUMENTS 4,471,591 A * 9/1984 Jamison ..... E04B 1/10 264/46.4
4,856,244 A * 8/1989 Clapp ..... E04C 2/386 52/309.7
5,770,295 A * 6/1998 Alderman ..... B32B 3/08 428/68
6,557,313 B1 * 5/2003 Alderman ..... B32B 7/02 52/407.2
6,715,241 B2 * 4/2004 Gelin ..... E04B 2/7412 52/144
6,766,619 B1 * 7/2004 Franz ..... E04B 1/3442 52/143
6,857,238 B2 * 2/2005 Alderman ..... B32B 5/02 52/406.3
7,127,858 B2 * 10/2006 Layfield ..... E04B 2/7411 52/407.1
8,495,852 B2 * 7/2013 Fay ..... E04B 1/62 52/745.13
9,702,152 B2 * 7/2017 Sievers ..... E04C 2/386
2004/0185226 A1 * 9/2004 Fay ..... B32B 7/00 428/138
2005/0188649 A1 * 9/2005 Hagen, Jr. ..... B29C 44/186 52/782.1
2008/0230249 A1 * 9/2008 Schroer ..... E04D 12/002 174/2
2011/0146174 A1 * 6/2011 Selvaag ..... E04B 2/707 52/302.1
2011/0314769 A1 * 12/2011 Foster, Sr. ..... E04D 15/00 52/749.12
2012/0159885 A1 * 6/2012 Oberg ..... E04B 2/58 52/404.3
2014/0318068 A1 * 10/2014 Jakobsen ..... E04B 1/762 52/506.05
2015/0218803 A1 * 8/2015 Rockwell ..... E04D 13/1637 52/404.2
2015/0300003 A1 * 10/2015 Jakobsen ..... E04B 1/762 52/506.05

FOREIGN PATENT DOCUMENTS

DE 29711017 U1 8/1997
EP 1160388 A2 12/2001
FR 2916461 A1 11/2008
NL 269087 A 6/1964
WO WO-8103041 A1 10/1981
WO WO-9828501 A1 7/1998
WO WO-2009153232 A1 12/2009

* cited by examiner

PREFABRICATED MODULE FOR A PITCHED ROOF ELEMENT AND PITCHED ROOF ELEMENT FOR A BUILDING ROOF

CROSS-REFERENCE TO RELATED APPLICATIONS

This application is a National Stage of International Application No. PCT/EP2017/056122 filed on Mar. 15, 2017, and published in English as WO2017/162498 A1 on Sep. 28, 2017. This application claims the priority to European Patent Application No. 16161965.5, filed on Mar. 23, 2016. The entire disclosures of the above applications are incorporated herein by reference.

FIELD

The present disclosure relates to a prefabricated module for a pitched roof element comprising a frame made of at least two first beams being arranged in a distance and running parallel to each other and two second beams running rectangular to the first beams and being connected to the ends of the first beams forming a compartment into which a first layer of an insulation is inserted. Furthermore, the present disclosure relates to a pitched roof element for a building roof made of at least two modules, each comprising a frame made of at least first beams being arranged in a distance and running parallel to each other and two second beams running rectangular to the first beams and being connected to the ends of the first beams forming a compartment into which a first layer of an insulation is inserted.

BACKGROUND

This section provides background information related to the present disclosure which is not necessarily prior art.

Generally it is known to provide an insulating roof support assembly for a roof structure comprising a plurality of roof elongated rafters spaced apart in a predetermined distance with insulation bars there between. On top of such roof support assembly roof tiles or other types of roof claddings are mounted.

It is also known to provide solutions for new-built buildings as well as for the refurbishment sector in order to deal with the constantly increasing requirements being specified in respect to thermal insulation respectively energy savings.

Nevertheless, providing a roof to a building assembly, especially a pitched roof is always time consuming, as roofers have to do a lot of working steps until the roof is finished. All the steps have to be done on the construction area by carpenters and roofers. In case of a pitched roof this has to be done on a sloped construction assembly.

First of all, the roof structures, typically of timber have to be installed on top of the top floor of the building assembly. Normally such roof structures of timber consist of roof beams, rafters, collar beams etc. After finishing the roof structures of timber battens, mainly slating and tiling battens have to be fixed on top of the rafters before for example tiles are fixed to the battens to finally weather protect the building roof construction. Insulation material has to be installed in-between the rafters and/or the battens to fulfill requirements with respect to thermal insulation. As all these works have to be done on the building site all the works are dependent on the weather conditions. In case of bad weather conditions these works can be interrupted and finalization of the whole project might be postponed.

In WO 2009/153232 there is disclosed an insulating building system for an external building structure, such as a wall or a roof, or an internal building structure of the above-mentioned kind. This building assembly comprises a top and a bottom profile with a plurality of joining profiles between the top and bottom frame profiles. The joining profiles have a first and second side surfaces which are abutted by the contact sides of adjacent insulating panels on each side of said joining profiles, wherein the profile contact sides of the insulation panels are provided with a shape matching the profile side surfaces of the joining profiles such that the insulation panels are retained between two profiles. The insulation panels thereby support the joining profiles and provide stability and strength to the wall structure and prevent the joining profiles from buckling.

However, these known insulating building systems are often complex, difficult to install on a roof, and furthermore there are increasing demands for extra thermal insulation in roof constructions in order to provide a comprehensive thermal building insulation.

SUMMARY

This section provides a general summary of the disclosure, and is not a comprehensive disclosure of its full scope or all of its features.

It is therefore an object of the present disclosure to provide a prefabricated module for a pitched roof element which can be easily installed on a building assembly whereby the installment can be made in short time with a high degree of safety for the installer, and whereby the roof element finally has thermal insulation characteristics fulfilling the increasing demands in order to provide a comprehensive thermal building insulation.

This object is achieved by a prefabricated module comprising a frame made of at least two first beams, typically wooden rafters, being arranged in a distance and running parallel to each other and two second beams running rectangular to the first beams and being connected to the ends of the first beams forming a compartment into which a first layer of an insulation made of mineral fibres and a binding agent is inserted. The prefabricated module further comprising a second layer of the insulation being arranged above the first layer of the insulation, covering the frame and being fixed at least to the first and/or the second beams, whereby the second layer of the insulation has a higher bulk density than the first layer of the insulation and whereby the first beams have a length being at least equal to an extension of the roof between a ridge purlin and an inferior purlin. It should be pointed out that in the context of the present disclosure insulation made of mineral fibres and a binding agent are to be understood as insulating products being rendered by and in accordance with European Standard EN 13162.

A major advantage of such a prefabricated module is that only this module has to be handled to build up a first half of a pitched roof element spanning from the ridge purlin to the inferior purlin. The module has already perfect thermal insulation characteristics as it contains two layers of insulation material, especially made of mineral fibres and a binding agent. Furthermore, the second layer of the insulation has a high bulk density and improved mechanical resistance so that workers can walk and stand on the insulation without risking to step through the insulation and getting hurt. This ensures a high degree of safety for the craftsmen during the installation.

Furthermore, the object is achieved by a pitched roof element made of two modules, each comprising a frame made of at least two first beams being arranged in a distance and running parallel to each other and two second beams running rectangular to the first beams and being connected to the ends of the first beams forming a compartment into which a first layer of an insulation made of mineral fibres and a binding agent is inserted, whereby the modules are connected pivotably to each other via a hinge being connected to a second beam of each frame so that the frames can be moved from a position in which the first beams of the frames are running parallel to each other and resting on each other to a position in which the frames enclose an angle between the first beams in the area of the hinge being at least equal to an angle between two halves of the roof forming a V-shaped adjustment.

Such a pitched roof element made of two modules has the big advantage that in principle the whole roof can be prefabricated. Depending on the width of a building to be covered with said roof elements it might be one or more elements to be arranged adjacent to each other but the whole roof is prefabricated off-site. Such elements are easily transported as the two halves of the roof elements are pivotably connected to each other by a hinge. During transportation the whole roof can be enveloped in a foil as to protect it against weather conditions. On the construction area the roof elements can be lifted by a crane to the top of the building assembly after the two modules of the pitched roof element are moved into the V-shaped adjustment. The pitched roof element can be arranged on top of the building assembly, fixed to it and final steps to finish the roof as arranging a covering on top of the modules can be started. Such a pitched roof element is easy and fast to install which massively decreases the time of building for example family homes. A further aspect is the prefabrication of the pitched roofs as it consists of two prefabricated modules which can be prefabricated in the factory with all necessary facilities and under defined conditions.

According to a further embodiment of the prefabricated module the first beams and/or the second beams are connected to a board, e.g. a cladding board being arranged adjacent to the first layer of the insulation and/or in that a membrane is arranged adjacent to the second layer of the insulation. To use boards being arranged adjacent to the first layer of the insulations being connected to the first beams and/or the second beams provides the module with a higher stability and makes it more easy to install the first layer of insulation into the compartment as this compartment is then closed on one side already. The first layer of insulation is normally a web-like insulation material made of mineral fibres and a binding agent. Such insulation layer is typically optimized in respect to its thermal performance, i.e. with a relatively low bulk density of e.g. 20 to 40 kg/m$^3$ and a declared thermal conductivity of about $\lambda D$=0.030 to 0.035 W/(m*K). The insulation material is clamp fitted into the compartment which has the advantage that the insulation layer is in contact to all beams forming the compartment. Thermal bridges because of gaps are avoided.

Furthermore, a vapor permeable membrane is arranged adjacent to the second layer of the insulation. The membrane covers the top side of the second layer and may be fixed to the outsides of the beams. Fixing means, like e.g. nails, clamps, cramps etc. can be used. The membrane protects the insulation layers against water ingress and accumulation of humidity in the construction. It may to some extent also protect the insulation from damages caused by workers walking on it while arranging the roof covering on top of the modules.

In yet another embodiment of the disclosure the second layer of the insulation is a dual density board made of mineral fibres and a binding agent. Therefore, the second layer of insulation contains two layers of insulation material having different densities. The upper layer with the higher bulk density is arranged on the outside of the module which gives an improved protection against damages as described before. Furthermore, such a dual density board has improved thermal characteristics as the bottom layer with the lower bulk density has a lower U-value, thus enhanced thermal properties compared to the upper layer of the second layer of the insulation having a higher bulk density.

Preferably the second layer of the insulation has a bulk density of at least 80 kg/m3 and/or a declared thermal conductivity of at least $\lambda D$=0.038 W/(m*K) and/or a high mechanical resistance indicated by a point load resistance of at least 120 kPa respectively 600 N per 50 cm$^2$ at a deformation of 5 mm according to European Standard EN 12430. Such a second layer of insulation provides excellent thermal insulating properties and moreover has a high resistance against point load so that it is protected against damages by workers standing or walking on the insulation. For the same reason the second insulation layer provides for more safety during mounting of the pitched roof elements to a building roof and the subsequent finishing with either roof tiles or other coverings.

According to another preferred embodiment of the disclosure counter battens running parallel to the first beams are fixed to the first beams and/or second beams whereby the second layer of the insulation is arranged between the counter battens and the frame. The present disclosure in that respect provides for an additional major benefit due to the extraordinary mechanical resistance of the second layer, namely in that the high point load resistance serves for a solid surface or bedding for the counter battens. This, is particular beneficial in view of the accuracy to be achieved for the mounting of said battens in a plane. It is much easier to arrive at a plane roof surface and accurate result for the final covering.

Moreover, the use of a second layer of insulation bridging the space between the frame and the counter battens ensures a nearly thermal bridge-free construction which easily fulfills present demands in relation to the thermal insulation of buildings. By way of example reference is made to the national Dutch building regulations defining minimum requirements in the so-called "Bowbesluit", e.g. table 5.1. For a roof construction which is subject to this disclosure e.g. a minimum RC-value of 6.0 (m2*K)/W is defined. Depending on the thicknesses of the insulation layers and the total construction, RC-values of 7.0 (m2*K)/W and higher can be achieved for the prefabricated modules respectively the pitched roof elements.

Thus, the elements according to the disclosure can also comply with e.g. the passive house demands according to recommendations by the German passive house institute (PHI), Darmstadt, as the roof construction can be provided with a U-value≤0.12 W/(m2*K), in particular as low as 0.1 W/(m2*K).

The modules will be prefabricated in total so that only the roof covering has to be installed after the module or the pitched roof element has been fixed to the building assembly. For this purpose it is of advantage to use tiling battens running parallel to the second beams, the ridge purlin and the inferior purlin being fixed to the counter battens.

A further advantageous module according to the disclosure is characterized in that at least a further beam is disposed between the outer first beams of the frame, whereby at least two compartments are provided between two beams and whereby the compartments have identical dimensions in length and/or width and/or depth. Such modules can be constructed with one, two, three or more compartments. Each compartment has a width according to the normally used webs made of mineral fibres and a binding agent being clamp fitted into the compartments. According to this as the compartments are constructed according to the usually used webs having a defined width modules of different width can be produced and used to build up pitched roofs of several lengths. Such modules can be used in a way of a construction kit giving the possibility of being combined top most of the length of roofs in the direction of the purlins as used especially in family homes. The modules forming one half of the pitched roof element can be arranged in different ways and connected via screws running through the first beams. To avoid thermal bridges thin layers of insulation material especially made of mineral fibres and a binding agent can be arranged between two first beams of neighbored modules.

Finally, the second layer of insulation has a thickness between 60 mm and 160 mm being thinner than the thickness of the frame and/or the first layer of the insulation having a thickness of at least 200 mm. These thicknesses may even further increase in order to meet future demands for thermal insulation and energy efficiency.

The pitched roof element according to the disclosure is advantageously developed in that each module comprises a second layer of insulation being arranged above the first layer of the insulation covering the frame and being fixed at least to the first and/or the second beams, whereby the second layer of the insulation has a higher bulk density than the first layer of the insulation and whereby the first beams have a length being at least equal to an extension of the roof between a ridge purlin and an inferior purlin. Furthermore, it is of advantage to have counter battens running parallel to the first beams and being fixed to the first beams and/or second beams whereby the second layer is arranged between the counter battens and the frame and second battens running parallel to the second beams, the ridge purlin and the inferior purlin being fixed to the counter battens. Such a roof is mainly prefabricated and ready to install on top of a building assembly whereby only the roof covering has to be arranged on top of the counter battens by workers. It may be of advantage to incorporate further insulation elements between these counter battens to increase the thermal insulation characteristics of the pitched roof element.

Finally, according to a further development of the roof both modules are provided with at least one fixing point to which an element to keep the modules in the V-shaped adjustment are fixable at least until the modules are fixed to a building. This element simplifies the installment of the prefabricated pitched roof element and it is of advantage to use two elements on both sides of the two modules just to stabilize the two halves of the roof in the V-shaped adjustment before putting it on the building assembly.

The before described disclosure relates especially to a pitched roof element having high insulation values, no thermal bridges and a vapor open construction. Furthermore, this roof according to the disclosure has characteristics of an air tight system with high acoustic performances. An exceptional fire resistance for the whole construction including the load-bearing parts is given so that installations, e.g. solar panels or the like can be installed above the rafters. The roof according to the disclosure has a high mechanical stability and it is therefore suitable for carrying such installations and has especially a suitable walkability even in the areas of the insulation layers without going the risk that the insulation is damaged. Furthermore, boards of mineral wool can be used as second insulation layer on top of the frame covering the frame and the first insulation layer. This second insulation layer can be fixed with nails to the frame which further reduces thermal bridges and which can be easily done by shooting the nails through the second layer of insulation into the beams of the frame.

The roof according to the disclosure is advantageous because insulation elements have a sufficient rigidity and good load-carrying capability in particular in a new-built situation, whilst at the same time being sufficient resilient so that any unevenness in the wooden rafters are avoided by using prefabricated modules having the rafters already included.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

In the following the disclosure is described in more details with reference to the accompanying drawings, in which.

Corresponding reference numerals indicate corresponding parts throughout the several views of the drawings.

DETAILED DESCRIPTION

Example embodiments will now be described more fully with reference to the accompanying drawings.

Figure 1:
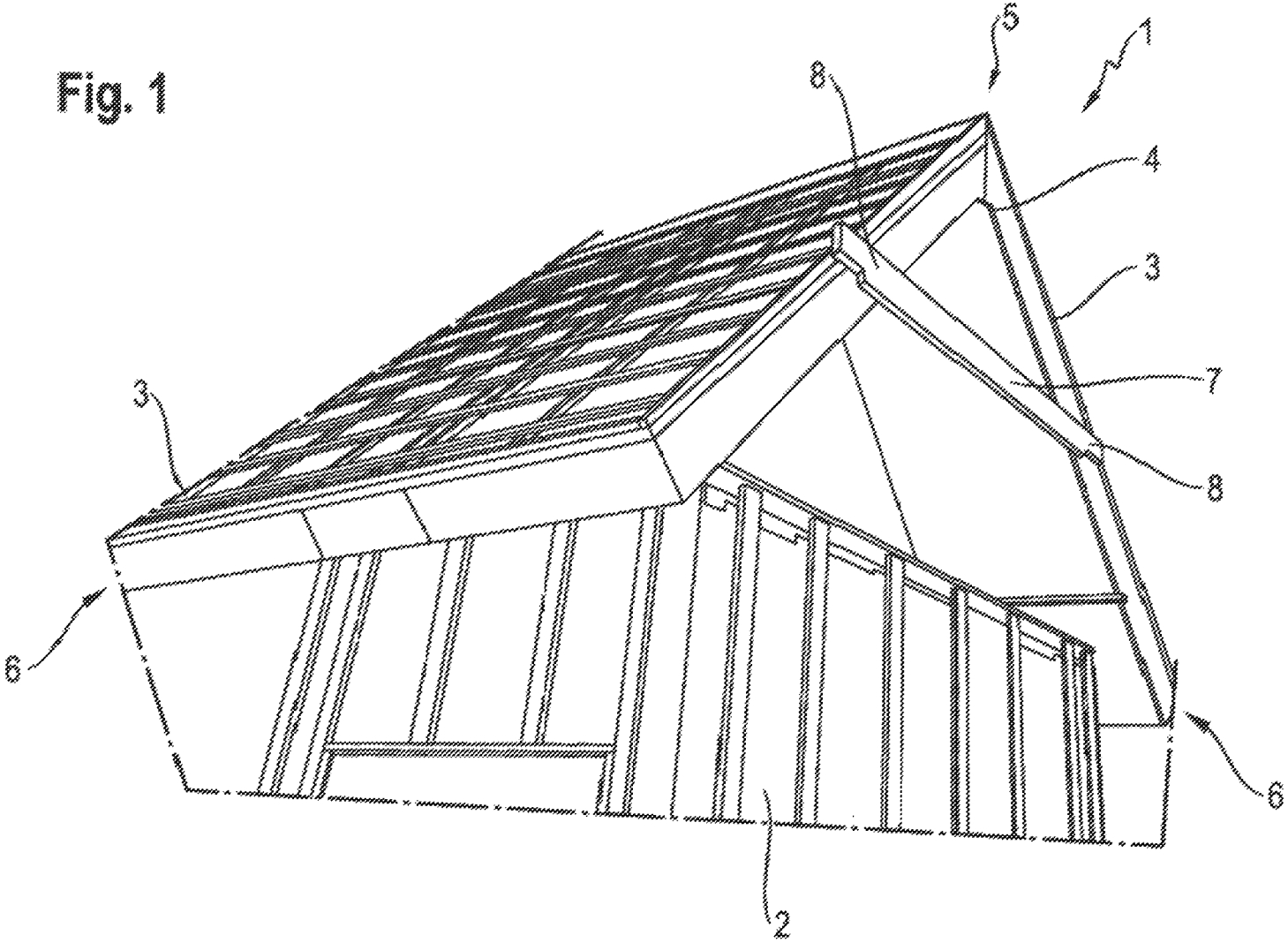
FIG. 1 shows part of a building roof with pitched roof elements made of prefabricated modules in a perspective view.

FIG. 1 shows a part of a building roof with three pitched roof elements 1 being arranged on a building assembly 2, such like in a family house. Each roof element consists of two modules 3, being described afterwards and being arranged in a V-shaped adjustment; each module 3 constitutes one half of the roof element 1.

The modules 3 are connected via a hinge 4 being arranged in the area of a ridge purlin 5. Said hinge 4 allows the two modules 3 to be moved from a position in which the modules 3 are lying parallel to each other to a position shown in FIG. 1 in which the modules 3 enclose an angle between the modules 3 in the area of the hinge 4 and the ridge purlin 5 being equal to an angle between the two modules 3 of the roof element 1 forming the V-shaped adjustment on the building assembly 2.

From FIG. 1 it can be seen that each half of the roof is constructed by using three modules 3 of which two outer modules 3 have an equal width and a module 3 being arranged between the outer modules 3 having a smaller width compared to the outer ones. The module 3 being arranged between the outer modules 3 has a width which approximately equals half of the width of the outer modules 3. The modules 3 are connected via screws which are not shown and which connect the modules 3 being neighbored to each other.

It can be seen that the modules 3 span at least from the ridge purlin 5 to both inferior purlins 6.

FIG. 1 furthermore shows an element 7 which keeps the modules 3 in the V-shaped adjustment and which is fixed to fixing points 8 and both modules 3 of the roof element 1. This element 7 can be fixed to the fixing points 8 before lifting the roof element 1 in the V-shaped adjustment to the building assembly 2 and can be removed after the roof element 1 is fixed to the building assembly 2.

It is evident that it is of advantage to use two of these elements 7 on both sides of the roof element 1, especially if the roof element 1 is lifted in total on top of the building assembly 2. In connection with smaller modules 3 one element 7 may be sufficient and especially in case of a roof according to FIG. 1 consisting of three modules 3 on each half of the roof it is of advantage only to use one element 7 as this element 7 has to be removed before the next part of the roof, namely two modules 3 being connected by a hinge 4 are lifted to the top of the building assembly 2 and being connected to the already installed modules 3 of the roof element 1. This is normally the case in the construction of row houses.

Figure 2:
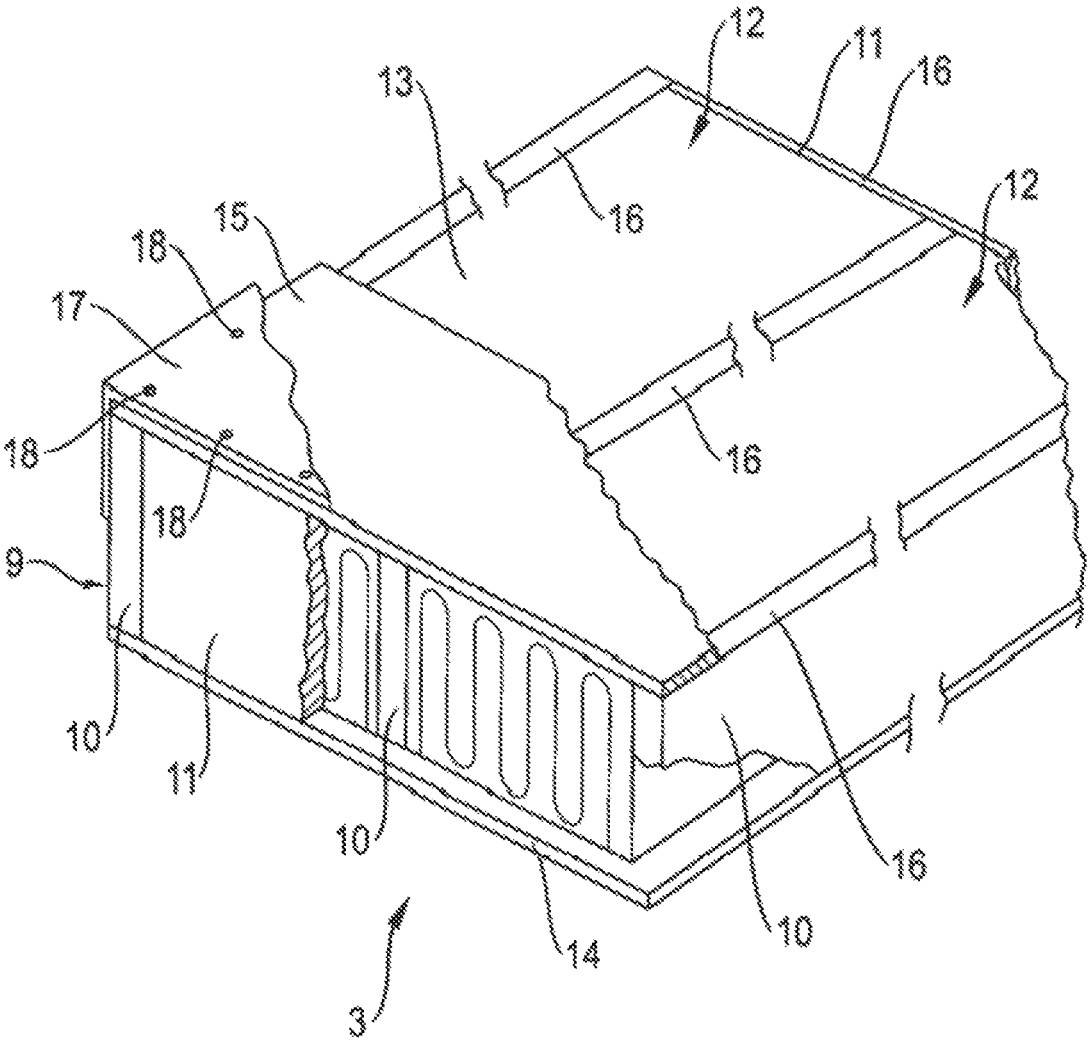
FIG. 2 shows a module in a perspective sectional view.
Figure 3:
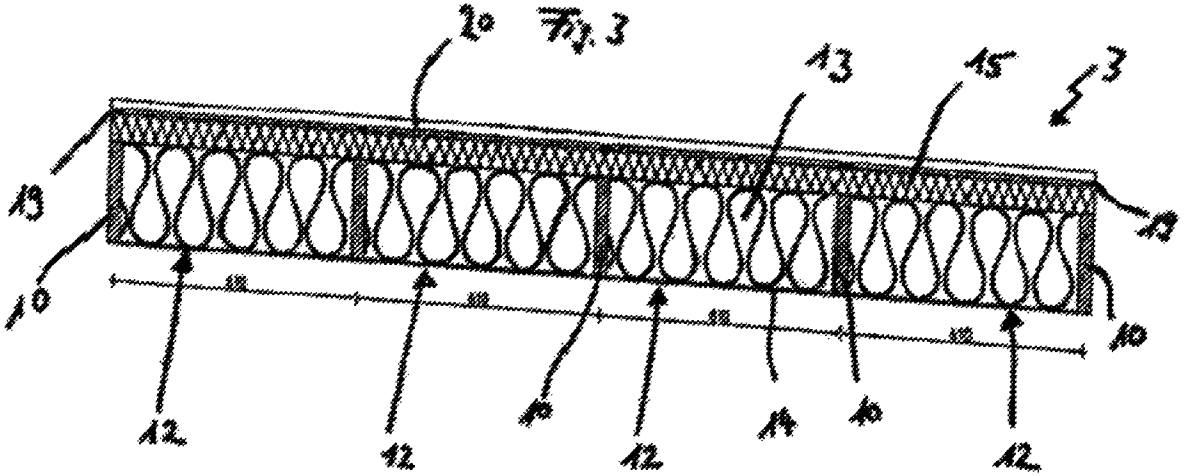
FIG. 3 shows the module according to FIG. 2 with additional counter battens in a sectional side view.
Figure 4:
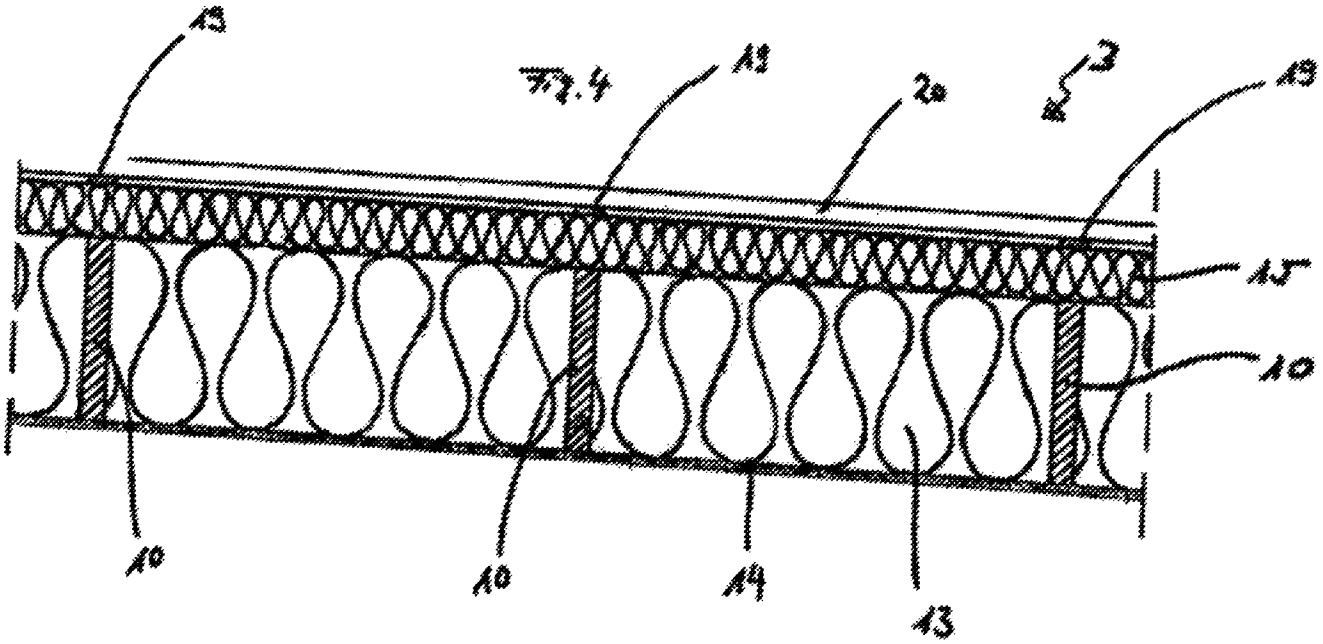
FIG. 4 shows the module according to FIG. 3 in an enhanced sectional side view and FIG. 5 shows a pitched roof element according to FIG. 1 in an enlarged sectional view of the connection of two modules.

FIGS. 2 to 4 show the modules 3 in more detail. FIG. 2 shows a module 3 comprising a frame 9 made of three first beams 10 being arranged in a distance and running parallel to each other. Two second beams 11 running rectangular to the first beams 10 are connected to the ends of the first beams 10 via screws or nails. Additionally, glue can be used as connection device. The second beams 11 run parallel to each other in a distance to each other which is equal to the extension of the roof element 1 from the ridge purlin 5 to one inferior purlin 6 and an overlap of the roof element 1 with respect to the building assembly 2.

Two neighbored first beams 10 and the two second beams 11 being arranged on either side of the first beams 10 provide a compartment 12 of rectangular shape into which a first layer 13 of an insulation made of mineral wool, i.e. mineral fibres and a binding agent is inserted. The first layer 13 is clamp fitted into the compartment 12 which means that the first layer 13 has a width being a little bit larger than the distance between the parallel running first beams 10.

The thickness of the first layer 13 of the insulation corresponds to the height of the first beams 10 but it might be possible to use a compressible first layer 13 being a little bit thicker than the height of the first beams 10 and therefore the compartment 12 so that a total filling of the compartment 12 with insulation material is ensured.

The first beams 10 and the second beams 11 are connected to a board 14 closing the compartments 12 on one side of the frame 9. Beams 10, 11 and board 14 are made of wood.

The connection of the beams 10, 11 and the board 14 can be arranged by screws and/or nails and additionally by using an adhesive.

According to FIG. 2 the prefabricated module 3 is provided with a second layer 15 of the insulation being made of boards consisting of mineral wool, i.e. mineral fibres and a binding agent. The board is a dual density board having an average density of about 90 kg/m3 and a declared thermal conductivity of about $\lambda D=0.038$ W/(m*K). As this board is a dual density board it has two layers (not shown) of different bulk densities whereby the layer with the lower bulk density is oriented to the first layer 13 of the insulation which means to surfaces 16 of the beams 10, 11.

It can be seen from FIG. 2 that the boards of the second layer 15 run from one outer first beam 10 to the second outer first beam 10 covering the first beam 10 being arranged in the middle between the two outer first beams 10. Furthermore, it can be seen that the lengthwise direction of the board constituting the second layer 15 is perpendicular to the lengthwise direction of the first layer 13 being made from a mineral fibre web.

Finally, the module 3 according to FIG. 1 shows a vapor permeable membrane 17 covering the second layer 15 and being fixed by nails 18 running through the second layer 15 to the beams 10, 11. Often nail fixing of the vapor permeable membrane 17 will take place with and through the counter battens 19.

The membrane 17 is waterproof and protects the module 3, especially the insulation material but also wooden beams against water ingress which can cause damages to the insulation and/or the mechanical parts of the module 3. It can be seen that part of the membrane covers the outside of the first beams 10 and of course the membrane 17 can be arranged in a way that also the outer parts of the second beams 11 are covered by the membrane 17.

One main aspect of the module 3 shown in FIG. 2 is that because of the second layer 15 having a higher bulk density than the first layer 13 the module 3 is sufficient for walking on the module 3 even in areas of the insulation without causing damages to the insulation. This advantage is achieved in that a second layer 15 made of boards is used having a high bulk density of more than 80 kg/m3, especially more than 120 kg/m3, a certain thickness and a dual density characteristics so that this results in a high mechanical resistance indicated by a point load resistance of at least 120 kPa respectively 600 N per 50 $cm^2$ at a deformation of 5 mm according to European Standard EN 12430. FIGS. 3 and 4 additionally show counter battens 19 running parallel to the first beams 11 and being fixed to the first beams 10 and in the area of the second beams 11 to the second beams 11 as well for example by using nails (not shown) running through the second layer 15 into the surfaces 16 of the beams 10, 11. On top of the counter battens 19 tiling battens 20 are arranged running parallel to the second beams 11, the ridge purlin 5 and the inferior purlin 6. These tiling battens 20 are arranged in a certain distance to each other which corresponds to devices being used for a roof covering. These devices may be tiles, especially plain tiles. With respect to the counter battens 19 it has to be pointed out that these counter battens 19 are arranged exactly over the first beams 10. The tiling battens 20 can be fixed to the counter battens 19 by nails running through the counter battens 19, the second layer 15 into the first beams 10.

FIG. 3 shows a specific example of a module 3 with four compartments 12 divided by first beams 10 being arranged at a center distance of 610 mm to each other. Each beam 10 has a thickness of 30 mm and a height of 220 mm so that a first insulation layer 13 has a thickness of 220 mm, too which may be achieved after a small compression of the first layer 13.

The second layer 15 consists of mineral wool boards, especially made of stone wool and binding agent having a thickness of 60 mm resulting in a total height of the module 3 without the counter battens 19, 20 of 290 mm being the addition of the height of the second layer 15, the first layer 13 and the thickness of the cladding board 14 being 10 mm.

The second layer 15 being made of dual density boards eliminates thermal bridges and makes it possible to stand on the whole surface of the module 3. The module 3 according to the disclosure establishes a safe vapor-open construction which can be easily handled as a prefabricated module or a prefabricated roof element 1 which decreases the time needed to build up a roof on a building assembly 2. Mineral wool provides for a very low value of water vapor diffusion resistance which may be assumed to be equal to $\mu=1$. The insulation layer will thus ensure that the moisture being included in the construction may easily disappear without causing any harm. A construction as has been described above and as is further shown in FIG. 4 with a construction height of 290 mm, a 10 mm cladding board 14 (chipboard, $\mu=10$) in the bottom and a vapor permeable membrane 17 (e.g. MorgoVent 120, $\mu=200$) on top, will result in an overall $\mu d$-value for the total construction equal to $\mu d=0.4298$ m. A simulation with the Glaser tool based on EN ISO 13788, climate class 2 confirms that no condensation and thus no accumulation of moist will appear in the construction. So, due to the vapor openness of the insulation and the membrane 17 the wooden beams are protected by an internal climate. The internal moisture percentage of the wood is protected and thereby a durable roof construction is ensured. This is yet another big benefit of a pitched roof construction utilizing modules and elements according to the present disclosure.

Furthermore, the second layer 15 provides a higher additional value in terms of acoustics and of course thermal accumulation and fire safety. The thermal performance of a construction, here the roof element 1 and the modules 3 is indicated by its thermal resistance or the Rc-value according to e.g. Dutch Standard NEN 1068 and will be at a minimum of 7.0 W/(m2*K). Depending on the thickness of the second layer 15 the thermal resistance can be in the range between 60 mm for Rc=7.0 W/(m2*K) via 100 mm for Rc=8.0 W/(m2*K) to 140 mm for Rc=9.0 W/(m2*K) or even higher.

Figure 5:
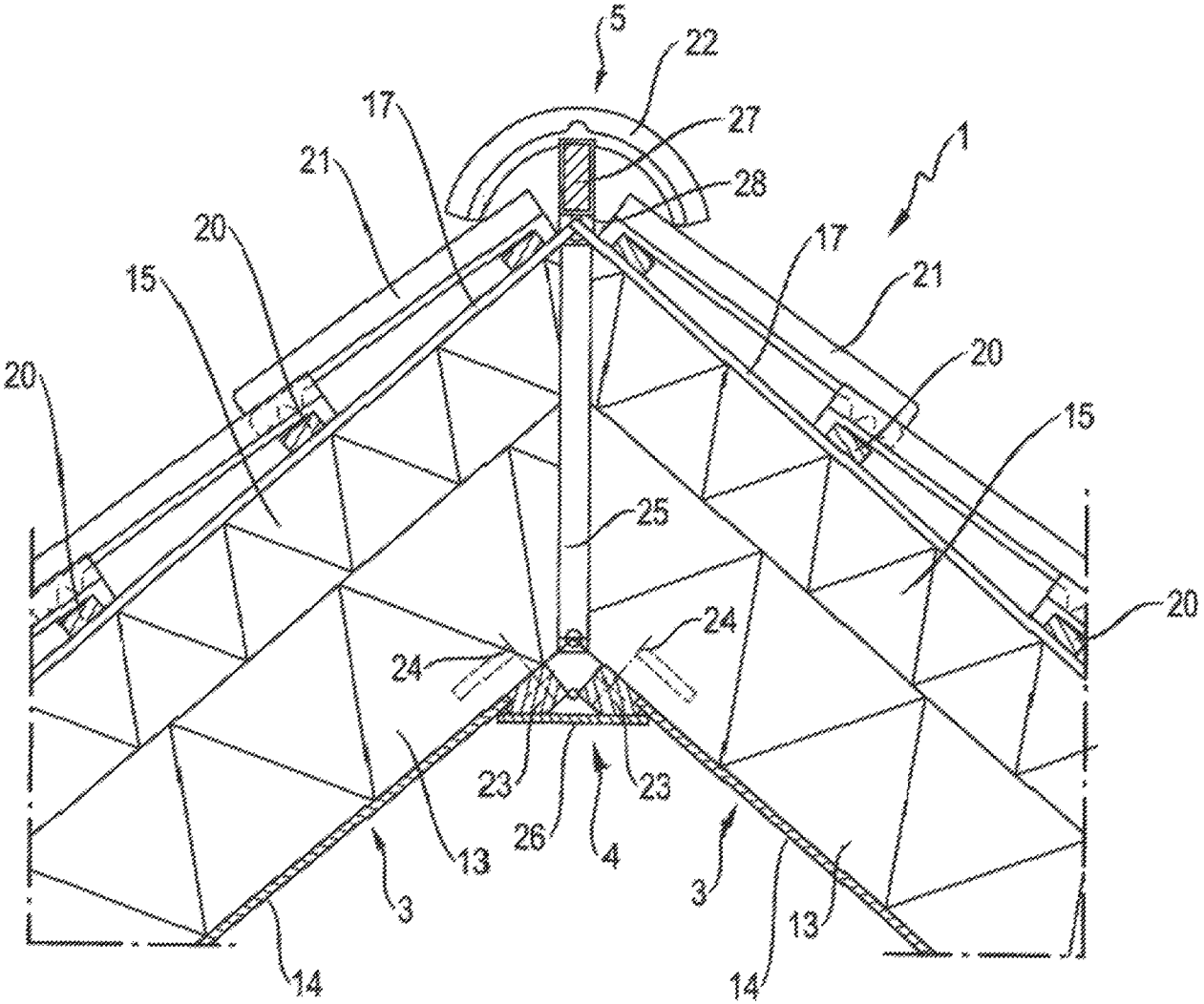

FIG. 5 shows the pitched roof element 1 according to FIG. 1 in an enlarged side view of the connection of two modules 3 via the hinge 4. The hinge 4 consists of two wooden ledges 23 being connected pivotably to each other and each being fixed to one module 3 via screws 24. The ledges 23 run along the whole module 3.

Furthermore, it can be seen from FIG. 5 that a strip 25 of insulation material is inserted between the two modules running from the ridge to the hinge 4. On top of the strip 25 a further ledge 27 is arranged in a profile element 28 clamped and fixed between the two modules 3 and being used to carry a ridge tile 22 covering a part of the uppermost tiles 21 being arranged on top of the roof element 1 and being connected to the tiling batten 20 with one end and being in contact with the second end on the outer surface of the tile 21 being arranged adjacent to. Finally, FIG. 5 shows a board 26 being connected to the wooden ledges 23 and thereby closing the gap between the two cladding boards 14 of the two modules 3 being connected to each other via the hinge 4.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A prefabricated module for a pitched roof element comprising a frame made of at least two first beams being arranged in a distance to each other and running parallel to each other and two second beams running perpendicular to the first beams and being connected to ends of the first beams forming a compartment into which a first layer of an insulation made of mineral fibers and a binding agent is inserted and comprising a second layer of the insulation being arranged above the first layer of the insulation, covering the frame and being fixed at least to the first and/or the second beams, whereby the second layer of the insulation has a higher bulk density than the first layer of the insulation and whereby the first beams have a length being at least equal to an extension of a roof between a ridge purlin and an inferior purlin, wherein the second layer of the insulation is a dual density board made of mineral fibers and a binding agent, the dual density board having two layers of different bulk densities, wherein the layer with the lower bulk density is oriented to the first layer of the insulation and to upper narrow surfaces of the first and the second beams.

2. The prefabricated module according to claim 1, wherein, the first beams and/or the second beams are connected to a cladding board being arranged adjacent to the first layer of the insulation and wherein a membrane is arranged adjacent to the second layer of the insulation.

3. The prefabricated module according to claim 1, wherein, the second layer of the insulation has a bulk density of at least 80 kg/m$^3$ and/or a declared thermal conductivity of at least 0.038 W/(m$^2$*K).

4. The prefabricated module according to claim 1, wherein, a membrane is arranged adjacent to the second layer of the insulation.

5. The prefabricated module according to claim 1, wherein, counter battens running parallel to the first beams and are fixed to the second beams whereby the second layer is arranged between the counter battens and the frame.

6. The prefabricated module according to claim 5, wherein, tiling battens are fixed to the counter battens whereby the tiling battens are running parallel to the second beams, the ridge purlin and the inferior purlin.

7. The prefabricated module according to claim 1, wherein, at least a further beam is disposed between outer first beams of the frame, whereby at least two compartments are provided between the outer first beams and whereby the compartments have identical dimensions in lengths and/or widths and/or depths.

8. The prefabricated module according to claim 1, wherein, the second layer of insulation has a thickness between 60 mm and 160 mm being thinner than the thickness of the frame and/or the first layer of insulation having a thickness of at least 200 mm.

9. The prefabricated module according to claim 1, wherein, the module has a thermal resistance Rc-value of 7.0 (m2*K)/W or higher.

10. A pitched roof element made of at least two modules according to claim 1, whereby the modules are connected pivotably to each other via a hinge being connected to a second beam of each frame so that the frames can be moved from a position in which the first beams of the frames are running parallel to each other and lying on each other to a position in which the frames enclose an angle between the first beams in the area of the hinge being at least equal to an angle between two halves of the roof element forming a V-shaped adjustment.

11. The pitched roof element according to claim 10, wherein, each module comprises a second layer of the insulation being arranged above the first layer of the insulation, covering the frame and being fixed at least to the first and/or the second beams, whereby the second layer of the insulation has a higher bulk density than the first layer of the insulation and whereby the first beams have a length being at least equal to an extension of the roof between a ridge purlin and an inferior purlin.

12. The pitched roof element according to claim 10, wherein, both modules are provided with at least one fixing point to which an element to keep the modules in the V-shaped adjustment are fixable at least until the modules are fixed to a building.

* * * * *